US007387197B2

(12) United States Patent
Sprouse et al.

(10) Patent No.: US 7,387,197 B2
(45) Date of Patent: Jun. 17, 2008

(54) LINEAR TRACTOR DRY COAL EXTRUSION PUMP

(75) Inventors: Kenneth M. Sprouse, Northridge, CA (US); David R. Matthews, Simi Valley, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 147 days.

(21) Appl. No.: 11/520,154

(22) Filed: Sep. 13, 2006

(65) Prior Publication Data

US 2008/0060914 A1 Mar. 13, 2008

(51) Int. Cl.
*B65G 15/00* (2006.01)

(52) U.S. Cl. ..... 198/626.1; 198/497

(58) Field of Classification Search ... 198/626.1–626.5, 198/497

See application file for complete search history.

(56) References Cited

U.S. PATENT DOCUMENTS 1,011,589 A * 12/1911 Curtis ..... 29/6.1
3,245,517 A * 4/1966 Ward ..... 198/495
3,844,398 A * 10/1974 Pinat ..... 198/626.6
4,069,911 A * 1/1978 Ray ..... 198/626.5
4,611,646 A * 9/1986 Wassmer et al. ..... 144/117.1
4,988,239 A 1/1991 Firth
5,094,340 A * 3/1992 Avakov ..... 198/626.1
5,435,433 A * 7/1995 Jordan et al. ..... 198/626.5
5,492,216 A * 2/1996 McCoy et al. ..... 198/626.5
6,257,567 B1 * 7/2001 Hansmann et al. ..... 270/58.07
6,296,110 B1 * 10/2001 van Zijderveld et al. .... 198/635
6,533,104 B1 * 3/2003 Starlinger-Huemer et al. .... 198/626.1
6,875,697 B2 * 4/2005 Trivedi ..... 438/700

OTHER PUBLICATIONS

Sprouse, K.M., Matthews, D.R., and Weber, G.F. "The PWR/DOE High-Pressure Ultra-Dense Phase Feed System and Rapid-Mix Multi-Element Injector for Gasification", Gasification Technologies Council meeting, Washington, D.C., Oct. 2006.

Aldred D. and Saunders, T. "Successful Continuous Injection of Coal into Gasification and PFBC System Operating Pressures Exceeding 500 PSI—DOE Funded Program Results", Pittsburgh Coal Conference Gasification Technologies, 2005.

* cited by examiner

*Primary Examiner*—Mark A Deuble
(74) *Attorney, Agent, or Firm*—Kinney & Lange, P.A.

(57) ABSTRACT

A pump for transporting particulate material includes an inlet, an outlet, a passageway, a first and second load beam, a first and second scraper seal, and a first and second drive assembly. The inlet introduces the particulate material into the passageway and the outlet expels the particulate material from the passageway. The passageway is defined by a first belt assembly and a second belt assembly that are opposed to each other. The first and second load beams are positioned within the first belt assembly and the second belt assembly, respectively. The first scraper seal and a second scraper seal are positioned proximate the passageway and the outlet. The first drive assembly is positioned within an interior section of the first belt assembly and drives the first belt assembly and the second drive assembly is positioned within an interior section of the second belt assembly and drives the second belt assembly.

23 Claims, 6 Drawing Sheets

LINEAR TRACTOR DRY COAL EXTRUSION PUMP

STATEMENT REGARDING FEDERALLY SPONSORED RESEARCH OR DEVELOPMENT

This invention was made with the support of the United States Government under Contract No. DE-FC26-04NT42237 awarded by the Department of Energy (DOE). The United States Government has certain rights in the invention.

BACKGROUND OF THE INVENTION

The coal gasification process involves turning coal or other carbon-containing solids into synthesis gas. While both dry coal and water slurry can be used in the gasification process, dry coal pumping is more thermally efficient than current water slurry technology. For example, dry coal gasifiers have a thermal cold gas efficiency of approximately 82%, compared to water slurry gasifiers, which have a thermal cold gas efficiency of between approximately 70% and approximately 77%.

One of the devices currently being used to pump dry coal to a high pressure is the cycling lock hopper. While the thermal cold gas efficiency of cycling lock hopper fed gasifiers is higher than other currently available technology in the gasification field, the mechanical efficiency of the cycling lock hopper is relatively low, approximately 30%. The capital costs and operating costs of cycling lock hoppers are also high due to the high pressure tanks, valves, and gas compressors required in the cycling lock hopper process. Additionally, due to the complexity of the process and the frequency of equipment replacement required, the availability of the cycling lock hopper is also limited. Availability refers to the amount of time the equipment is on-line making product as well as to the performance of the equipment.

In order to simplify the process and increase the mechanical efficiency of dry coal gasification, the use of dry coal extrusion pumps has steadily become more common in dry coal gasification. Some of the problems associated with currently available dry coal extrusion pumps are internal shear failure zones and flow stagnation problems. The presence of failure zones can lead to a decreased mechanical efficiency in the pump. Some proposed solutions to internal shear failure zones and flow stagnation problems are to increase the pump flow rate and to use a linear or axial flow field geometry, rather than a cylindrical solids flow field geometry. While these solutions may increase the mechanical efficiency of the dry coal extrusion pump, other problems still persist.

BRIEF SUMMARY OF THE INVENTION

A pump for transporting particulate material includes an inlet, an outlet, a passageway, a first and second load beam, a first and second scraper seal, and a first and second drive assembly. The inlet introduces the particulate material into the passageway and the outlet expels the particulate material from the passageway. The passageway is defined by a first belt assembly and a second belt assembly that are opposed to each other. The first and second load beams are positioned within the first belt assembly and the second belt assembly, respectively. The first scraper seal and a second scraper seal are positioned proximate the passageway and the outlet. The first drive assembly is positioned within an interior section of the first belt assembly and drives the first belt assembly; and the second drive assembly is positioned within an interior section of the second belt assembly and drives the second belt assembly.

DETAILED DESCRIPTION

The dry coal extrusion pump transports pulverized dry coal and includes an inlet, an outlet, and a passageway positioned between the inlet and the outlet for transporting the pulverized dry coal through the pump. The passageway is defined by a first belt assembly and a second belt assembly that are each formed from a plurality of belt links and link rotation axles. The first and second belt assemblies each have an interior section. The interior section of the first and second belt assemblies include first and second drive assemblies, respectively, which drive the belt assemblies in opposite directions. A first load beam and a second load beam are also positioned within the interior section of the belt assemblies and take the load from the pulverized dry coal and maintain the belt assemblies in a substantially linear form. A first scraper seal and second scraper seal are positioned proximate the outlet and provide a seal between the pressurized interior of the pump and the atmosphere.

Figure 1A:
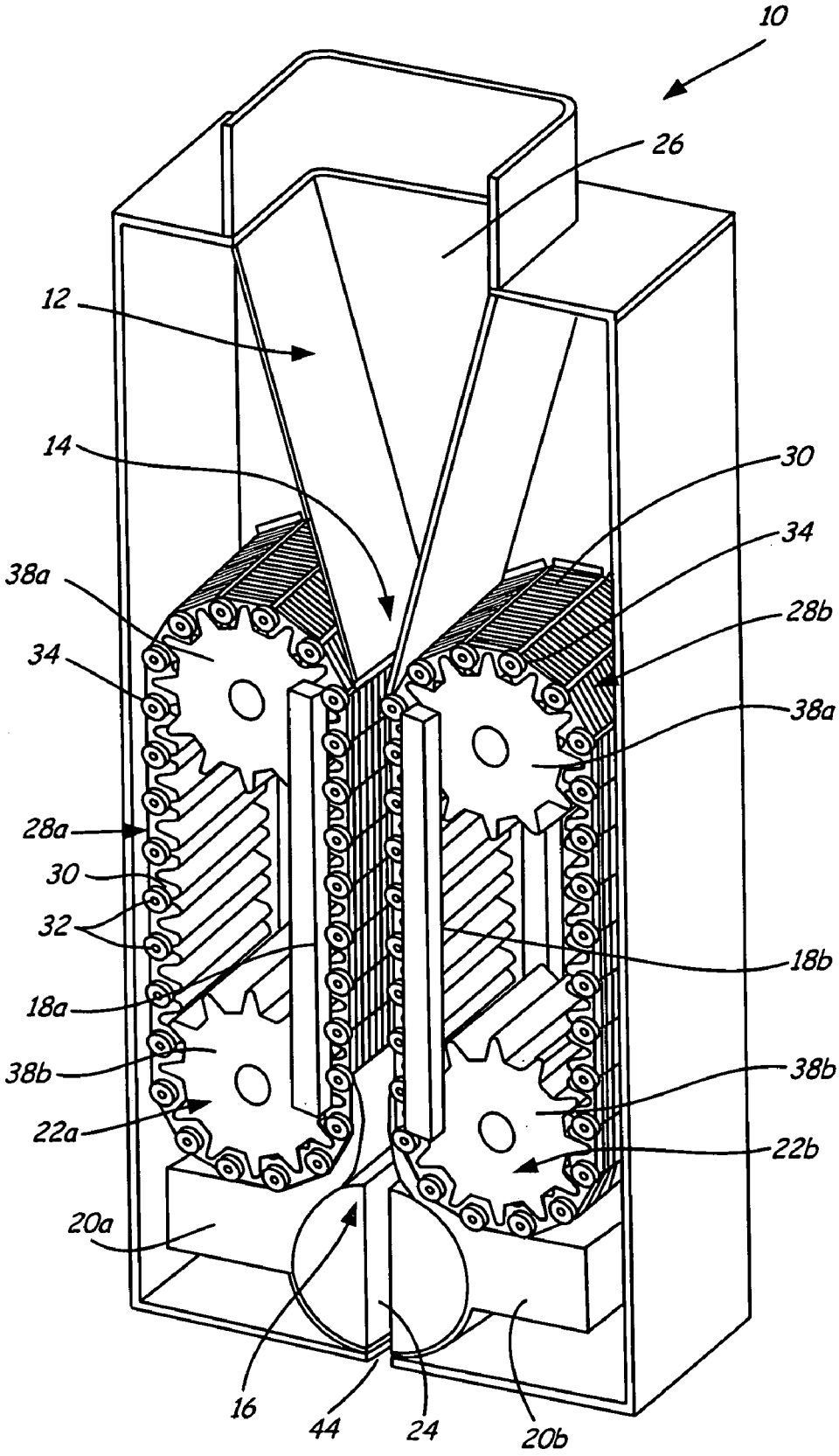
FIG. 1A is a perspective view of a dry coal extrusion pump.
Figure 1B:
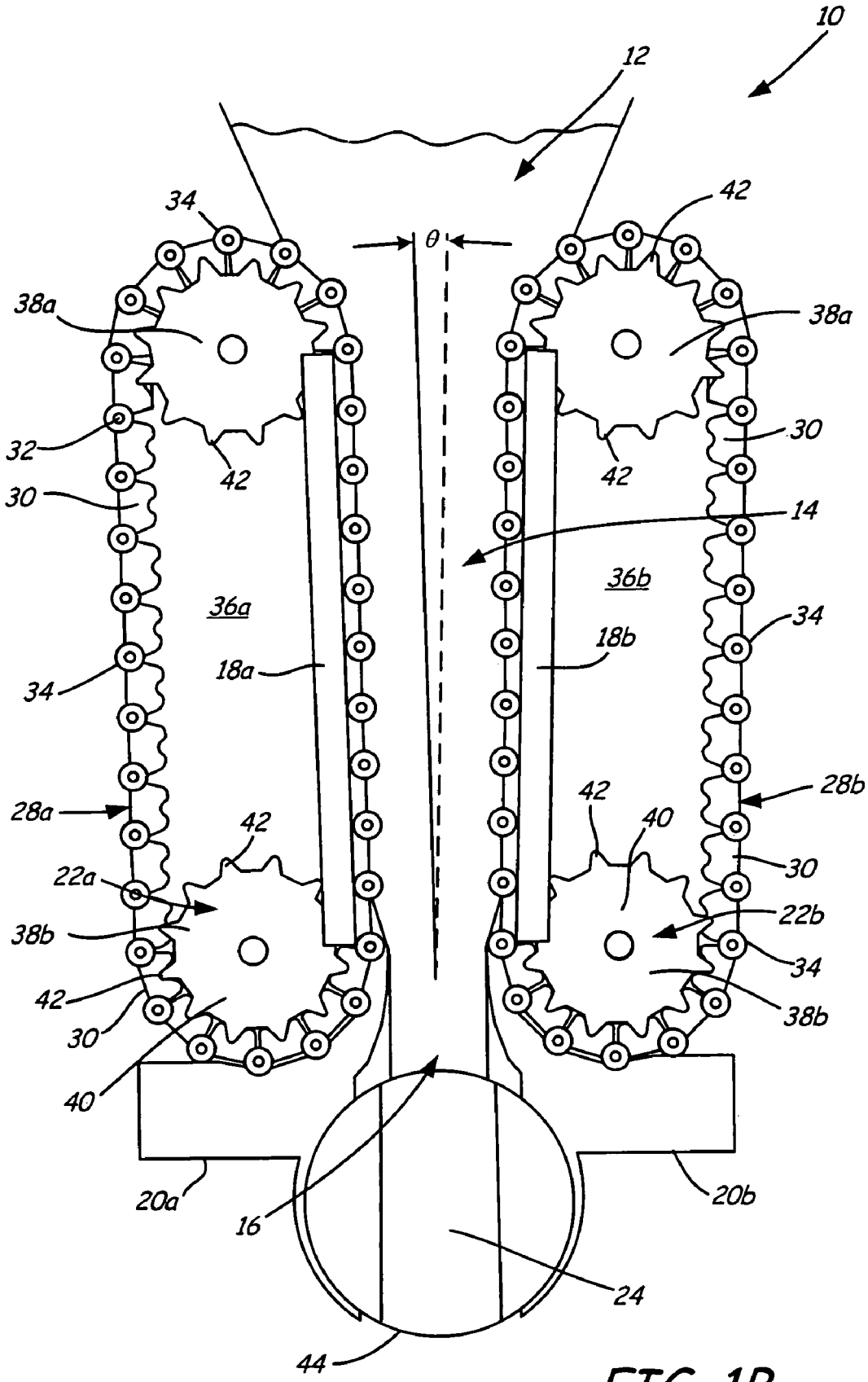
FIG. 1B is a side view of the dry coal extrusion pump.

FIGS. 1A and 1B show a perspective view and a side view, respectively, of a dry coal extrusion pump 10 for transporting pulverized dry coal. Pump 10 has increased efficiency by eliminating shear failure zones and flow stagnation zones within pump 10. Flow stagnation zones occur where pulverized dry coal is driven into walls at substantially right angles or impinged by other pulverized dry coal moving in the opposite direction. By substantially reducing or eliminating shear failure zones and flow stagnation zones, the mechanical efficiency of pump 10 can approach approximately 80%. In addition, pump 10 is capable of pumping pulverized dry coal into gas pressure tanks with internal pressures of over 1200 pounds per square inch absolute. Although pump 10 is discussed as transporting pulverized dry coal, pump 10 may transport any dry particulate material and may be used in various industries, including, but not limited to the following markets: petrochemical, electrical power, food, and agricultural.

Pump 10 generally includes inlet 12, passageway 14, outlet 16, first load beam 18*a*, second load beam 18*b*, first scraper seal 20*a*, second scraper seal 20*b*, first drive assembly 22*a*, second drive assembly 22*b*, valve 24, and end wall 26. Pulverized dry coal is introduced into pump at inlet 12, send through passageway 14, and expelled from pump 10 at outlet 16. Passageway 14 is defined by first belt assembly 28*a* and second belt assembly 28*b*, which are positioned substantially parallel and opposed to each other.

First belt assembly 28*a* is formed from belt links 30 connected to each other by link rotation axles 32 (shown in FIGS. 2A, 2B, and 2C) and track wheels 34. Link rotation axles 32 allow belt links 30 to form a flat surface as well as allow belt links 30 to bend around first drive assembly 22*a*. First belt assembly 28*a* defines an inner section 36*a* in which first drive assembly 22*a* is located. Track wheels 34 cover ends of link rotation axles 32 and function to transfer the mechanical compressive loads normal to belt links 30 into load beam 18*a*. In an exemplary embodiment, first belt assembly 28*a* is formed from between approximately thirty-two (32) and approximately fifty (50) belt links 30 and link rotation axles 32. First belt assembly 28*a*, together with second belt assembly 28*b*, pushes the pulverized dry coal through passageway 14.

Second belt assembly 28*b* includes belt links 30, link rotation axles 32, track wheels 34, and second inner section 36*b*. Belt links 30, link rotation axles 32, track wheels 34, and second inner section 36*b* are connected and function in the same manner as belt links 30, link rotation axles 32, track wheels 34, and first inner section 36*a* of first belt assembly 28*a*.

First and second load beams 18*a* and 18*b* are positioned within first belt assembly 28*a* and second belt assembly 28*b*, respectively. First load beam 18*a* carries the mechanical load from first belt assembly 28*a* and maintains the section of first belt assembly 28*a* defining passageway 14 in a substantially linear form The pulverized dry coal being transported through passageway 14 creates solid, stresses on first belt assembly 28*a* in both a compressive outward direction away from passageway 14 as well as in a shearing upward direction toward inlet 12. The compressive outward loads are carried from belt links 30 into link rotation axles 32, into track wheels 34, and into first load beam 18*a*. First load beam 18*a* thus prevents first belt assembly 28*a* from collapsing into first interior section 36*a* of first belt assembly 28*a* as the dry pulverized coal is transported through passageway 14. The shearing upward loads are transferred from belt links 30 directly into drive sprockets 38*a* and 38*b* and drive assembly 22*a*.

Second load beam 18*b* is formed and functions in the same manner as first load beam 18*a* to maintain second belt assembly 28*b* in a substantially linear form at passageway 14 and to transfer outward compressive and upward shearing loads from belt links 30 to second load beam 18*b*, drive sprockets 38*a* and 38*b*, and second drive assembly 22*b*.

First scraper seal 20*a* and second scraper seal 20*b* are positioned proximate passageway 14 and outlet 16. First belt assembly 28*a* and first scraper seal 20*a* form a seal between pump 10 and the outside atmosphere. Thus, the few pulverized dry coal particles that become caught between first belt assembly 28*a* and first scraper seal 20*a* become a moving pressure seal for first belt assembly 28*a*. The exterior surface of first scraper seal 20*a* is designed to make a small angle with the straight section of first belt assembly 28*a* in order to scrape the pulverized dry coal stream off from moving first belt assembly 28*a*. The angle prevents pulverized dry coal stagnation that may lead to low pump mechanical efficiencies. In an exemplary embodiment, first scraper seal 20*a* makes a 15 degree angle with the straight section of first belt assembly 28*a*. First scraper seal 20*a* may be made of any suitable material, including, but not limited to, hardened tool steel.

Second scraper seal 20*b* is formed and functions in the same manner as first scraper seal 20*a* to prevent stagnation at second belt assembly 28*b* of pump 10.

First drive assembly 22*a* is positioned within first interior section 36*a* of first belt assembly 28*a* and drives first belt assembly 28*a* in a first direction. First drive assembly 22*a* includes at least two drive sprockets 38*a* and 38*b* positioned at opposing ends of first belt assembly 28*a*. Each of drive sprockets 38*a* and 38*b* has a generally circular shaped base 40 with a plurality of sprocket teeth 42 protruding from base 40. Sprockets 42 interact with first belt assembly 28*a* and drives first belt assembly 28*a* around drive sprockets 38*a* and 38*b*. In an exemplary embodiment, first drive assembly 22*a* rotates first belt assembly 28*a* at a rate of between approximately 1 foot per second and approximately 5 feet per second (ft/s). First drive assembly 22*a* preferably rotates first belt assembly 28*a* at a rate of approximately 2 ft/s.

Likewise, second drive assembly 22*b* includes at least two drive sprockets 38*a* and 38*b* positioned within second interior section 36*b* of second belt assembly 28*b* for driving second belt assembly 28*b*. Second drive assembly 22*b* is formed and functions in the same manner as first drive assembly 22*a*, except that second drive assembly 22*b* drives second belt assembly 28*b* in a second direction.

Valve 24 is positioned proximate outlet 16 of pump 10 and is switchable between an open position and a closed position. A slot 44 runs through valve 24 and controls whether the pulverized dry coal may pass through outlet 16 of pump 10 into a discharge tank (not shown) positioned beneath pump 10. The width of slot 44 is larger than outlet 16 between scraper seals 20*a* and 20*b*. When valve 24 is in the closed position, slot 44 is not aligned with passageway 14 and outlet 16, preventing the pulverized dry coal from exiting pump 10. Valve 24 is typically in the closed position when first and second belt assemblies 28*a* and 28*b* of pump 10 are not rotating. Valve 24 remains in the closed position as pump 10 starts up. Once first and second belt assemblies 28*a* and 28*b* begin rotating, valve 24 is rotated 90 degrees to the open position (shown in FIG. 1B). When valve 24 is in the open position, slot 44 is aligned with passageway 14 and outlet 16, allowing the pulverized dry coal in passageway 14 to flow through pump 10 to the discharge tank. In an exemplary embodiment, valve 24 is a cylinder valve.

The distance between sprockets 38*a* and 38*b* (in each of first and second drive assembly 22*a* and 22*b*), the convergence half angle θ between load beams 18*a* and 18*b*, and the separation distance between scraper seals 20*a* and 20*b* are optimized to achieve the highest mechanical solids pumping efficiency possible for a particular pulverized material without incurring detrimental solids back flow and blowout inside pump 10. High mechanical solids pumping efficiencies are obtained when the mechanical work exerted on the solids by pump 10 is reduced to near isentropic (i.e., no solids slip) conditions. For a solids pump, the isentropic work per unit mass of solids fed, $W_{isen}$, is given by:

$$W_{isen} = \frac{(P_d - P_{atm})}{\rho_s(1-\varepsilon)} \tag{1}$$

where the $P_d$ is the discharge gas pressure of pump 10, $P_{atm}$ is the atmospheric gas pressure (14.7 psia), $\rho_s$ is the true solids density without voids, and $\epsilon$ is the void fraction within passageway 14.

Detrimental solids back flow and blowout may be prevented by ensuring that the solids stress field within passageway 14 just upstream of scraper seals 20*a* and 20*b* is below the Mohr-Coulomb failure condition, or:

$$\left[\frac{(\sigma_x-\sigma_y)^2}{4}+\tau_{xy}^2\right]^{0.5} \le \frac{c}{(1-\varepsilon)}\cos\phi+\frac{(\sigma_x+\sigma_y)}{2}\sin\phi \quad (2)$$

where the variable $\tau_{xy}$ is the solids shearing stress within passageway 14, $\sigma_x$ is the compressive stress in the outward direction of passageway 14, $\sigma_y$ is the compressive stress in the axial direction of passageway 14, $\phi$ is the pulverized solids internal friction angle, and c is the pulverized solids coefficient of cohension.

Although the solids stress field will meet the Equation 2 equality (failure condition) in the region between scraper seals 20*a* and 20*b* where solids slip is occurring over stationary scraper seals 20*a* and 20*b*; the primary role of scraper seals 20*a* and 20*b* is to generate enough compressive solids pressure, $(\sigma_x+\sigma_y)/2$, in order to prevent solids slip on the moving tractor belt links 30 just upstream of scraper seals 20*a* and 20*b* where the shearing stresses, $\tau_{xy}$, are lower.

Additional compressive solids pressure, $(\sigma_x+\sigma_y)/2$, for the prevention of slip just upstream of scraper seals 20*a* and 20*b* can be generated by: increasing the distance between sprockets 38*a* and 38*b* in each of first and second drive assembly 22*a* and 22*b* (for increased length of passageway 14), decreasing the width of passageway 14, or converging load beams 18*a* and 18*b* at a half angle, $\theta$, between 0 and 5 degrees. The set of geometrical values to be used for these parameters is determined by the set that achieves the minimum mechanical pump work.

Figure 2:
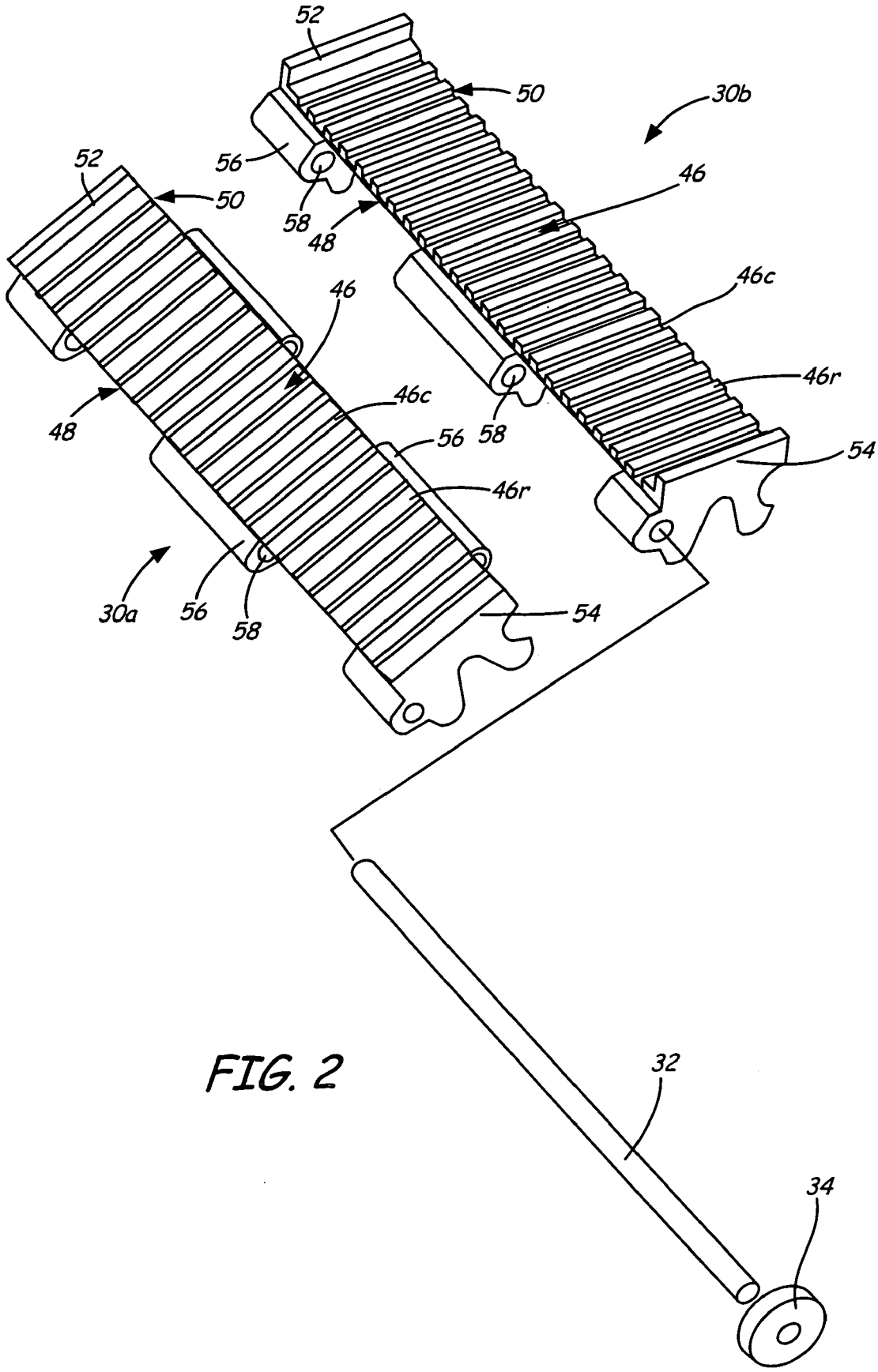
FIG. 2 is enlarged, perspective view of a belt link of the dry coal extrusion pump.

FIG. 2 shows a perspective view of belt link 30*a* and adjacent belt link 30*b* each having top surface 46, first side 48, second side 50, first end seal 52, second end seal 54, and protrusions 56. First and second end seals 52 and 54 of belt links 30 have an extended, trapezoidal shape. As can be seen in FIG. 2, top surface 46 of belt links include a series of rectangular cavities 46*c* and ridges 46*r*. End seals 52 and 54 protrude higher than top surface 46 and act to seal the pressurized chamber of pump 10 from the outside atmosphere. Protrusions 56 extend from first and second sides 48 and 50 of belt links 30 such that protrusions 56 extending from second side 50 of belt link 30*a* align with protrusions 56 extending from first side 48 of adjacent belt link 30*b*. Link rotation axle 32 passes through apertures 58 extending through protrusions 56, allowing belt links 30 to pivot around link rotation axle 32 as belt links 30 travel around drive sprockets 38*a* and 38*b* (shown in FIGS. 1A and 1B). Belt links 30 and link rotation axles 32 may be made of any suitable material, including, but not limited to, hardened tool steel.

Figure 3A:
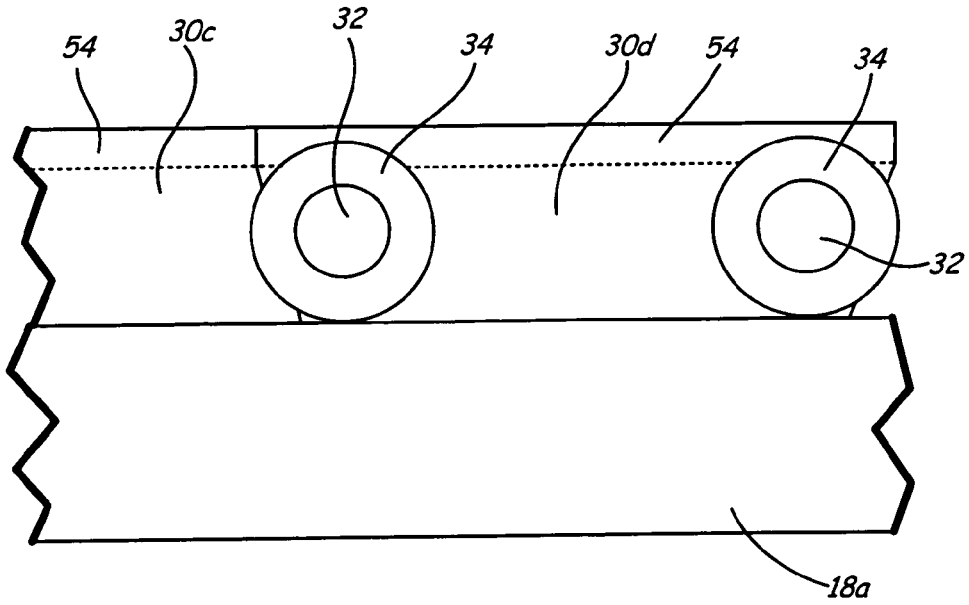
FIG. 3A is a partial, enlarged side view of an exemplary embodiment of an interface of belt links and a load beam.
Figure 3B:
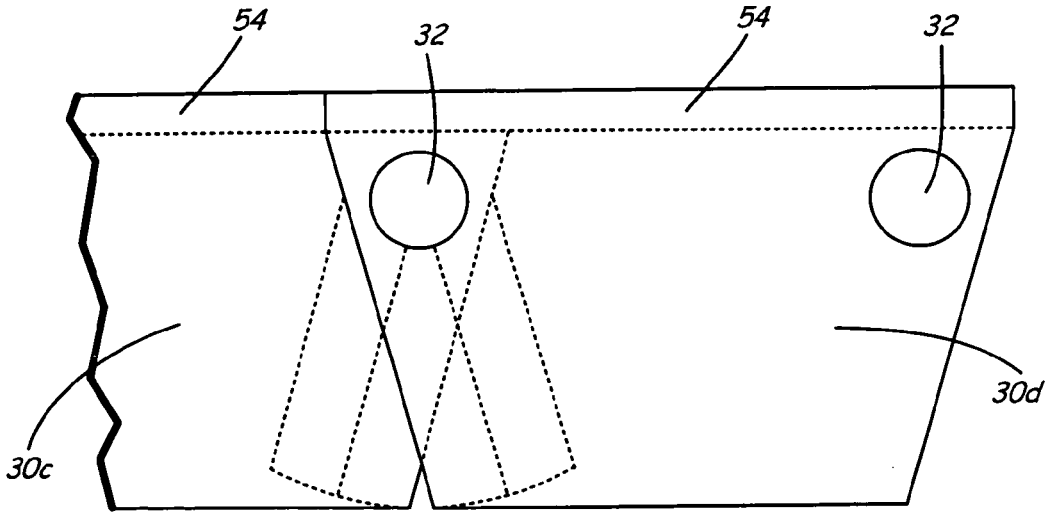
FIG. 3B is a partial, enlarged side view of a belt link and an adjacent belt link of the dry coal extrusion pump with the load beam removed.
Figure 3C:
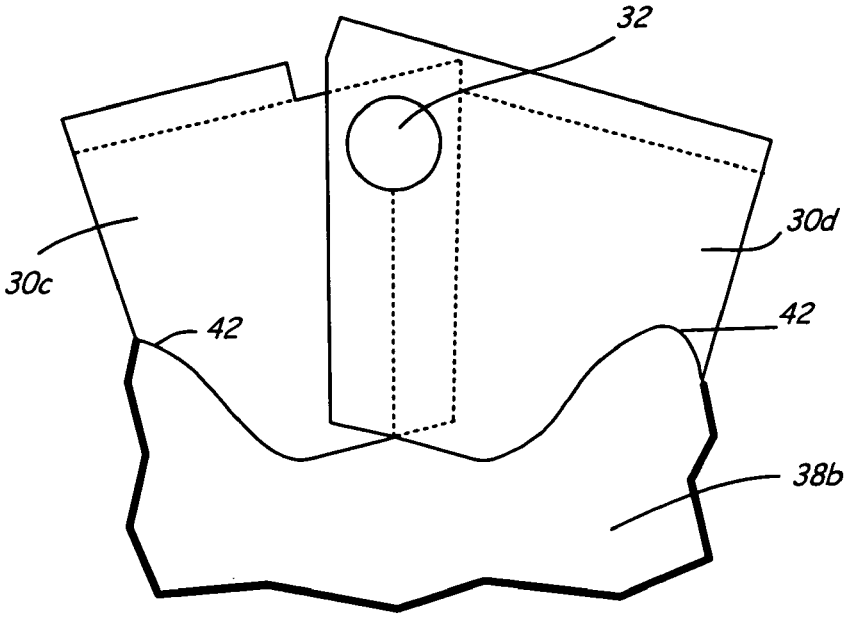
FIG. 3C is a partial, enlarged side view of an exemplary embodiment of an interface of the belt links and a drive sprocket.

FIG. 3A shows an enlarged, partial side view of an exemplary embodiment of an interface of belt links 30 and first load beam 18*a*. FIG. 3B shows an enlarged, partial side view of an exemplary embodiment of belt link 30*c* and adjacent belt link 30*d* with first load beam 18*a* and track wheels 34 removed. FIG. 3C shows an enlarged, partial side view of an exemplary embodiment of an interface of belt links 30 and drive sprocket 38*b* with track wheels 34 removed. FIGS. 3A, 3B, and 3C will be discussed in conjunction with each other. Belt links 30 are held together by link rotation axles 32 and track wheels 34. As can be seen in FIG. 3B, link rotation axles 32 allow belt links 30 to form a flat surface between drive sprockets 38*b* when top surfaces 46 of adjacent belt links 30*a* and 30*b* are aligned with each other. The flat surface created by top surfaces 46 of belt links 30 eliminates solids flow stagnation zones by eliminating zones where pulverized dry coal is driven into walls at substantially right angles or impinged by other pulverized dry coal moving in the opposite direction.

As can be seen in FIG. 3C, link rotation axles 32 also allow belt links 30 to bend around each of drive sprockets 38*a* and 38*b* of first drive assembly 22*a* that are driving first belt assembly 28*a*. The backside of belt links 30 contain a series of cut-outs (shown in dashed lines in FIGS. 3B and 3C) that allow belt link 30*c* to collapse into an adjacent belt link 30*d* as first belt assembly 28*a* moves around sprockets 42 of drive sprockets 38*a* and 38*b*. Thus, belt link 30*c* will have material removed so that belt link 30*d* can fold into adjacent belt link 30*b*. Likewise, adjacent belt link 30*d* will also have material removed so that belt link 30*c* can fold into adjacent belt link 30*d*. These cut-outs on backside of belt links 30 allow belt links 30 to fold up on one another in order to go around drive sprocket 38.

Belt links 30, link rotation axles 32, track wheels 34, second load beam 18*b*, and drive sprockets 38*a* and 38*b* of second drive assembly 22*b* and second belt assembly 28*b* interact and function in the same manner as belt links 30, link rotation axles 32, track wheels 34, first load beam 18*a*, and drive sprockets 38*a* and 38*b* of first drive assembly 22*a* and first belt assembly 28*a*.

Figure 4A:
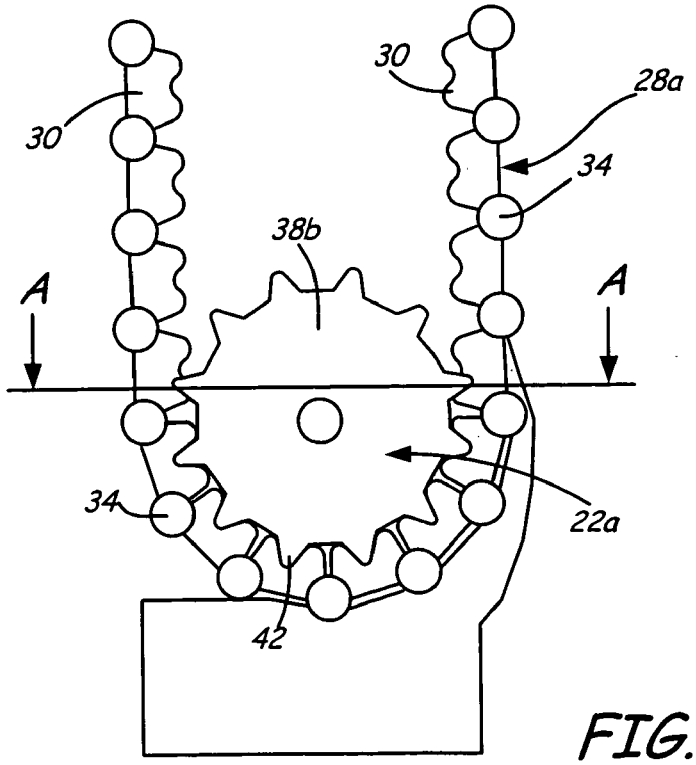
FIG. 4A is a partial side view of a belt link assembly interfacing a drive-sprocket.
Figure 4B:
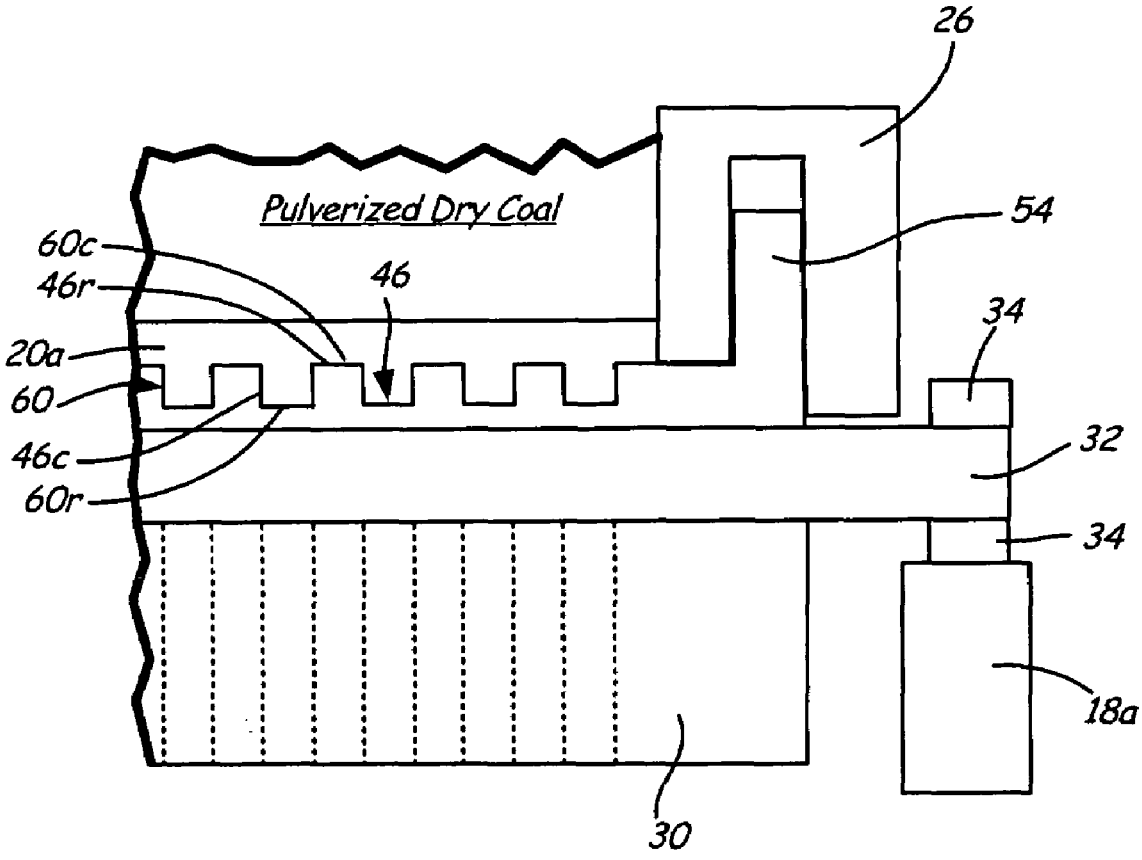
FIG. 4B is a cross-sectional view of an interface of the belt link and a seal scraper at line A-A shown in FIG. 4A.

FIGS. 4A and 4B show a partial side view of first belt link assembly 28*a* interfacing drive sprocket 38*b* and a cross-sectional view of an interface of belt link 30 with first scraper seal 20*a*, respectively. FIG. 4A has first load beam 18*a* removed to better illustrate the cross-sectional view shown in FIG. 4B. Similar to top surface 46 of belt link 30, interior surface 60 of first scraper seal 20*a* also includes a series of rectangular cavities 60*c* and ridges 60*c*. The series cavities 46*c* and ridges 46*r* of top surface 46 of belt link 30 interlock with the series of rectangular cavities 60*c* and ridges 60*r* of first scraper seal 20*a* to form a tight fitting seal that prevents the pulverized dry coal and high pressure gas at outlet 16 from blowing out of pump 10 to the outside ambient pressure environment. End seals 52 and 54 of belt links 30 also interact with end wall 26 to seal the pressurized chamber of pump 10 to the outside atmosphere. The labyrinth seal created by end seals 52 and 54 trap small pulverized dry coal particles and generate enough friction drag between the pulverized dry coal particles and end seals 52 and 54 to prevent excessive pulverized coal or pressurized gas from discharging at end wall 26. The moving/stationary interface between belt links 30 and end wall 26 are thus maintained at a minimum area by filling the region with the pulverized dry coal, which has a very large flow resistance within the interface region of belt links 30 and end wall 26.

Belt links 30 and second scraper seal 20*b* interact and function in the same manner as belt links 30 and first scraper seal 20*a* to prevent pulverized dry coal and high pressure gas from escaping pump 10 to the atmosphere.

Although the present invention has been described with reference to preferred embodiments, workers skilled in the art will recognize that changes may be made in form and detail without departing from the spirit and scope of the invention.

The invention claimed is:

1. A pump for transporting particulate material comprising:

a passageway defined by a first belt assembly and a second belt assembly, wherein each of the first belt assembly and the second belt assembly has an interior section and wherein the first belt assembly and the second belt assembly are opposed to each other;

an inlet for introducing the particulate material into the passageway;

an outlet for expelling the particulate material from the passageway;

a first load beam positioned within the interior section of the first belt assembly;

a second load beam positioned within the interior section of the second belt assembly;

a first scraper seal and a second scraper seal positioned proximate the passageway and the outlet;

a first drive assembly positioned within the interior section of the first belt assembly for driving the first belt assembly; and a second drive assembly positioned within the interior section of the second belt assembly for driving the second belt assembly.

2. The pump of claim 1, wherein each of the first belt assembly and the second belt assembly comprises a plurality of belt links pivotally connected to each other by a plurality of link rotation axles.

3. The pump of claim 2, and further comprising a first labyrinth seal at an interface between the first belt assembly and the first scraper seal, and a second labyrinth seal at an interface between the second belt assembly and the second scraper seal.

4. The pump of claim 1, wherein each of the first drive assembly and the second drive assembly comprises at least two drive sprockets.

5. The pump of claim 1, wherein the first belt assembly and the second belt assembly rotate in opposing directions.

6. The pump of claim 1, wherein the first scraper seal and the second scraper seal in combination with a portion of the particulate material form a seal for the pump.

7. The pump of claim 1, and further comprising a valve positioned proximate the outlet of the pump.

8. The pump of claim 1, wherein the first load beam and the second load beam converge at half angles between about 0 and about 5 degrees.

9. A particulate transporting pump having reduced shearing zones, the particulate transporting pump comprising:

a first end for introducing particulates;

a second end for expelling the particulates;

a first belt assembly positioned between the first end and the second end;

a second belt assembly positioned between the first end and the second end, wherein the first belt assembly and the second belt assembly are positioned opposite each other to form a particulate passageway;

a first load beam for carrying load from the first belt assembly;

a second load beam for carrying load from the second belt assembly;

a plurality of scraper seals for forming a seal within the particulate transporting device; and a driving mechanism for transporting the particulates through the passageway from the first end to the second end.

10. The pump of claim 9, wherein each of the first belt assembly and the second belt assembly comprises a plurality of belt links pivotally connected to each other by a plurality of link rotation axles, and wherein each of the first belt assembly and the second belt assembly has an interior section.

11. The pump of claim 10, wherein the driving mechanism comprises a plurality of drive sprockets positioned within the interior sections of the first belt assembly and the second belt assembly.

12. The pump of claim 9, and further comprising an end wall for forming a first labyrinth seal between the first belt assembly and the first scraper seal, and for forming a second labyrinth seal between the second belt assembly and the second scraper seal.

13. The pump of claim 9, wherein the driving mechanism transports the particulates under pressure.

14. The pump of claim 9, wherein the first scraper seal is positioned adjacent the first belt assembly and the second end, and wherein the second scraper seal is positioned adjacent the second belt assembly and the passageway.

15. The pump of claim 9, and further comprising a valve positioned at the second end.

16. The pump of claim 9, wherein the first belt assembly and the second belt assembly rotate in opposite directions.

17. The pump of claim 9, wherein the first load beam and the second load beam converge at half angles between about 0 and about 5 degrees.

18. A method of pumping particulates comprising:

feeding the particulates into an inlet;

driving the particulates through a passageway defined a first belt assembly and a second belt assembly;

supporting the passageway while driving the particulates through the passageway;

scraping particulates from the first belt assembly and the second belt assembly to form a seal, respectively; and expelling the particulates from an outlet.

19. The method of claim 18, wherein driving the particulates through a passageway defined by a first belt assembly and a second belt assembly comprises rotating the first belt assembly in a first direction and rotating the second belt assembly in a second direction.

20. The method of claim 19, wherein rotating the first belt assembly in a first direction and the second belt assembly in a second direction comprises using a plurality of drive sprockets positioned within the first belt assembly and the second belt assembly.

21. The method of claim 18, wherein supporting the passageway comprises a positioning a first load beam within the first belt assembly and positioning a second load beam within the second belt.

22. The method of claim 21, wherein the first load beam and the second load beam converge at half angles between about 0 and about 5 degrees.

23. The method of claim 18, wherein scraping particulates from the first belt assembly and the second belt assembly to form a seal comprises using a first scraper seal and a second scraper seal, respectively.

* * * * *

UNITED STATES PATENT AND TRADEMARK OFFICE

CERTIFICATE OF CORRECTION

PATENT NO. : 7,387,197 B2
APPLICATION NO. : 11/520154
DATED : June 17, 2008
INVENTOR(S) : Kenneth M. Sprouse et al.

It is certified that error appears in the above-identified patent and that said Letters Patent is hereby corrected as shown below:

Column 8, Line 28, delete “defined a”, insert --defined by a--

Column 8, Line 46, delete “comprises a positioning”, insert --comprises positioning--

Signed and Sealed this

Seventh Day of October, 2008

JON W. DUDAS
*Director of the United States Patent and Trademark Office*